US012338589B2

(12) United States Patent
Cui et al.

(10) Patent No.: US 12,338,589 B2
(45) Date of Patent: Jun. 24, 2025

(54) REPLACEABLE AND FATIGUE-AVOIDED ORTHOTROPIC PLATE STRUCTURE AND REPLACING METHOD THEREOF

(71) Applicants: Bing Cui, Beijing (CN); Canhui Zhao, Nanjing (CN); Huanling Wu, Nanjing (CN); Zhiming Guo, Chengdu (CN); Liang Tang, Chengdu (CN)

(72) Inventors: Bing Cui, Beijing (CN); Canhui Zhao, Nanjing (CN); Huanling Wu, Nanjing (CN); Zhiming Guo, Chengdu (CN); Liang Tang, Chengdu (CN)

( * ) Notice: Subject to any disclaimer, the term of this patent is extended or adjusted under 35 U.S.C. 154(b) by 909 days.

(21) Appl. No.: 17/452,777

(22) Filed: Oct. 29, 2021

(65) Prior Publication Data

US 2023/0135646 A1 May 4, 2023

(51) Int. Cl.
*E01D 19/12* (2006.01)
*E01D 22/00* (2006.01)

(52) U.S. Cl.
CPC ..... *E01D 19/125* (2013.01); *E01D 22/00* (2013.01)

(58) Field of Classification Search
CPC ..... E01D 19/125; E01D 22/00
USPC ..... 14/73, 77.3
See application file for complete search history.

(56) References Cited

U.S. PATENT DOCUMENTS 1,526,359 A * 2/1925 Michie ..... E01D 2/02 52/125.4
3,066,771 A * 12/1962 Wolchuk ..... E01D 19/125 52/478
3,302,361 A * 2/1967 Oudheusden, Jr. ... E01D 19/125 52/798.1
3,308,725 A * 3/1967 Nagin ..... E01D 19/083 52/509
4,042,991 A * 8/1977 Macy ..... E04B 5/14 52/645
4,120,065 A * 10/1978 Sivachenko ..... E01D 19/103 14/24

(Continued)

FOREIGN PATENT DOCUMENTS

CN 206359892 U 7/2017
CN 107938508 A 4/2018

(Continued)

*Primary Examiner* — Raymond W Addie
(74) *Attorney, Agent, or Firm* — Bayramoglu Law Offices LLC

(57) ABSTRACT

A replaceable and fatigue-avoided orthotropic plate structure includes a plurality of U rib components detachably arranged. The U rib component includes a U rib. The upper end of the U rib is fixedly connected to the roof plate in a non-welded manner. A replacing method includes that when a structural abnormality is detected in a target U rib component, sequentially removing connecting pieces between a connecting plate corresponding to the target component and a diaphragm; pulling out the connecting plate and the limiting plate corresponding to the target component; sequentially removing connecting pieces between an upper end of a U rib corresponding to the target component and the roof plate; installing a U rib component for replacement at a position corresponding to the target component with the connecting pieces; and installing the connecting plate and the limiting plate at the original position with the connecting pieces.

17 Claims, 6 Drawing Sheets

(56) References Cited

U.S. PATENT DOCUMENTS

| | | | | | |
|---|---|---|---|---|---|
| 4,129,917 | A * | 12/1978 | Sivachenko | E01D 11/02 | 52/843 |
| 4,706,319 | A * | 11/1987 | Sivachenko | E01D 19/103 | 14/73 |
| 5,339,475 | A * | 8/1994 | Jaeger | E01D 19/125 | 404/70 |
| 5,457,840 | A * | 10/1995 | Derechin | E01D 19/125 | 14/73 |
| 5,603,134 | A * | 2/1997 | Whipkey | E01D 15/133 | 52/592.1 |
| 5,651,154 | A * | 7/1997 | Ahlskog | E01D 19/125 | 52/588.1 |
| 6,081,955 | A * | 7/2000 | Dumlao | E01D 2/00 | 52/783.17 |
| 8,572,788 | B2 * | 11/2013 | Kurek | E04G 13/04 | 52/258 |
| 8,925,132 | B1 * | 1/2015 | Quinonez | E01D 2/02 | 14/77.1 |

FOREIGN PATENT DOCUMENTS

| | | | |
|---|---|---|---|
| CN | 109732243 | A | 5/2019 |
| CN | 110939077 | A | 3/2020 |
| KR | 20140040482 | A | 4/2014 |

* cited by examiner

REPLACEABLE AND FATIGUE-AVOIDED ORTHOTROPIC PLATE STRUCTURE AND REPLACING METHOD THEREOF

TECHNICAL FIELD

The present invention relates to the technical field of civil engineering, in particular to a replaceable and fatigue-avoided orthotropic plate structure and a replacing method thereof.

BACKGROUND

A steel orthotropic plate is a load-bearing structure composed of vertical and horizontal stiffening ribs (or diaphragm) and a steel roof plate. The self-weight of the steel orthotropic plate is about ¼-⅕ of the self-weight of the reinforced concrete bridge deck or the precast prestressed concrete bridge deck; and the transportation and erection of the steel orthotropic plate is convenient and the construction period is short.

Kurpfalz bridge, which was built in 1950 using the orthotropic steel bridge deck technology proposed in 1930s, is the first steel structure bridge in the world that takes the steel orthotropic plate structure as a part of the main girder to bear stress, and simultaneously as the bridge deck to bear the local traffic load. Since then, the technology has been widely used in steel structure bridge engineering.

However, since it's been in use for nearly 70 years, the steel orthotropic bridge deck exposes some problems: firstly, due to the welding of U rib and steel roof plate and the existence of weld joint and welding stress, U rib, steel roof plate, and the weld joint between the U rib and the steel roof plate are prone to fatigue cracking; secondly, because the side of U rib is welded with diaphragm, the diaphragm near the U rib and the weld joint between the U rib and the diaphragm are prone to fatigue cracking.

Once the above fatigue crack damage occurs, it is difficult to repair or replace, and the damage may become a stubborn issue affecting the use of steel orthotropic bridge deck. The main reason is that the small steel box is formed after the U rib and the steel roof plate are welded, which is subjected to the torsion around the longitudinal axis and the vertical bending around the transverse axis under the wheel load. During the torsion, the external torque needs to be balanced with the bending moment at the joint between the U rib and the steel roof plate, resulting in a large relative deformation at the joint between the U rib and the steel roof plate. Moreover, the geometric stiffness is discontinuous at the joint, and a relatively large cyclic stress is produced at the joint under the reciprocating load, which easily leads to the fatigue cracking at the weld joint between the U rib and the steel roof plate, as shown in FIG. 1.

Meanwhile, when the U rib undergoes the vertical bending around the transverse axis, the repeated out-of-plane bending of the diaphragm will occur under the external reciprocating load due to the welding of the U rib and the diaphragm, thereby leading to the fatigue cracking at the weld joint between the U rib and the diaphragm, as shown in FIG. 2.

SUMMARY

In view of the shortcomings in the prior art, the present invention provides a replaceable and fatigue-avoided orthotropic plate structure and a replacing method to solve the problems that the orthotropic plate is prone to fatigue damage and the damage is not easy to repair in the prior art.

In order to solve the above technical problems, the present invention adopts the following technical solution.

A replaceable and fatigue-avoided orthotropic plate structure is provided, including a plurality of U rib components detachably arranged. Each of the plurality of U rib components includes a U rib, and an upper end of the U rib is fixedly connected to a roof plate in a non-welded manner; undertaking plates are attached on outer sides of both sides of the U rib, and the undertaking plate abuts against and is connected to a side-inclined limiting component; the side-inclined limiting component includes a connecting plate detachably installed on a diaphragm, and a limiting plate is arranged vertically on the connecting plate; a friction plate matched with the undertaking plate is installed on the limiting plate, and the friction plate and the undertaking plate are closely against each other to form a friction pair; two sides of a bottom of the U rib are symmetrically fixedly arranged with vertical limiting components, and an upper end of the vertical limiting component abuts against and is connected to a lower end of the limiting plate.

The present invention also provides a method for replacing the replaceable and fatigue-avoided orthotropic plate structure, including the following steps:

- S1, when a structural abnormality is detected in a predetermined U rib component, sequentially removing connecting pieces between the connecting plate corresponding to the target component and the diaphragm;
- S2, pulling out the connecting plate corresponding to the target component and the limiting plate corresponding to the target component in a direction perpendicular to the diaphragm;
- S3, sequentially removing connecting pieces between the upper end of the U rib corresponding to the target component and the roof plate;
- S4, installing a U rib component for replacement at a position corresponding to the target component with the connecting pieces obtained in S3;
- S5, installing the connecting plate and the limiting plate obtained in S2 at the original position with the connecting pieces obtained in S1, to complete a replacement of the orthotropic plate structure.

The main advantages of the replaceable and fatigue-avoided orthotropic plate structure provided by the present invention are as follows:

For the fatigue-avoided orthotropic plate structure provided by the present invention, the friction plate tightly abuts against the undertaking plate on each side of the U rib to form a friction pair. When the U rib is vertically bent around the transverse axis, the fatigue damage of the diaphragm is avoided because a non-welded connection is used between the U rib and the diaphragm, the side-inclined limiting component constrains the vertical deformation of the U rib through the friction pair connection, and the U rib can be bent freely around the transverse axis without the out-of-plane bending of the diaphragm.

The U rib and the roof plate are fixedly connected in the non-welded manner, as a result, the welding stress caused by welding at the joint is relieved and meanwhile the resultant fatigue cracking of the weld joint and base material is eliminated. Furthermore, the torsional constraint of the diaphragm on the U rib around the longitudinal axis is effectively weakened, the stress at the connecting portion between the U rib and the roof plate is greatly reduced, and the fatigue of the U rib is avoided.

Through the cooperation of the side-inclined limiting component and the undertaking plate, the transverse position of the U rib can be limited and the U rib is not needed to be welded with the diaphragm. As such, the constraint of the diaphragm on the vertical bending of the U rib around the transverse axis is released, and the repeated out-of-plane bending of the diaphragm caused by the bending of the U rib is eliminated, so that the fatigue cracking of the weld joint between the U rib and the diaphragm and the fatigue cracking of arc-shaped notch are eliminated. Meanwhile, the vertical downward movement of the U rib is limited.

By setting the vertical limiting component at the lower part of the U rib, the upper end of the vertical limiting component abuts against and is connected to the limiting plate to form a limit when the U rib moves upward, thus limiting the vertical upward movement of the U rib.

The cooperation of the side-inclined limiting component and the vertical limiting component has a synergetic effect of restricting the movement of a workpiece in the vertical plane.

The U rib is only detachably connected to the roof plate, tightly abuts against and connected to the vertical limiting component, and is not fixedly connected to any other component, therefore, it is convenient to remove the U rib. Even if fatigue damage of the U rib component occurs, the damaged modular U rib component can also be wholly replaced.

The side-inclined limiting component and the diaphragm are connected in a detachable method, which facilitates replacement. The U rib component, the side-inclined limiting component, and the vertical limiting component are mutually detachable, thus able to be made into standardized components to facilitate manufacture, installation, and replacement.

When using the method for replacing the replaceable and fatigue-avoided orthotropic plate structure provided by the present solution, the connecting plate and the limiting plate are horizontally removed, conducive to extracting the side-inclined limiting component for reuse. Moreover, the components for connection are reused, thus prolonging the service life of each structure and saving cost.

Figure 1:
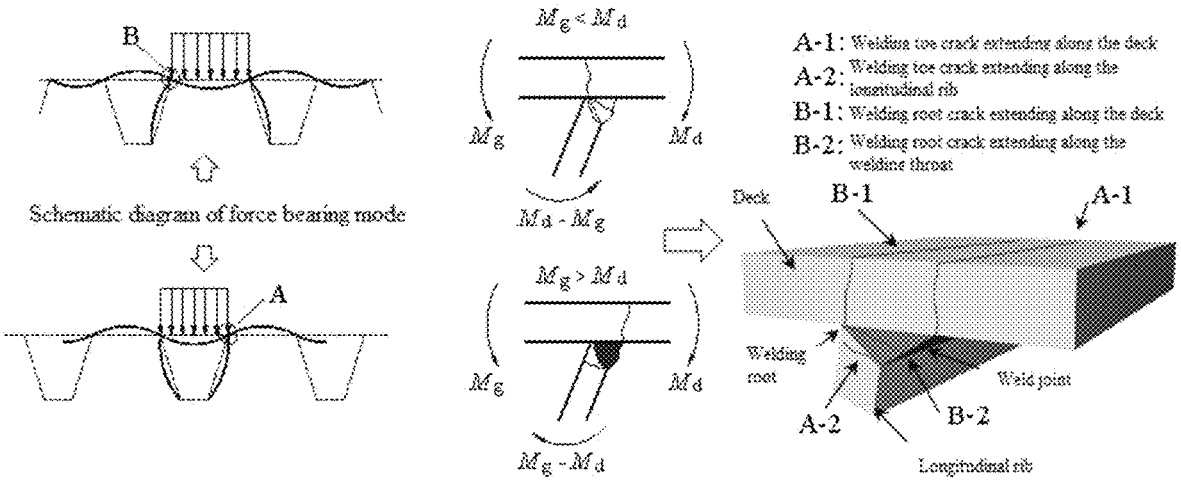
FIG. 1 is a schematic diagram of the lateral deformation of the existing orthotropic bridge deck under wheel load.
Figure 2:
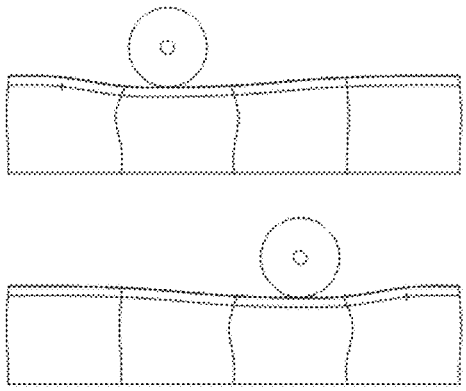
FIG. 2 is a schematic diagram of the vertical deformation and diaphragm bending of the existing orthotropic bridge deck under wheel load.

In the drawings: 100, U rib component; 101, U rib; 102, undertaking plate; 200, side-inclined limiting component; 201, connecting plate; 202, limiting plate; 203, friction plate; 300, vertical limiting component; 301, arc-shaped flange; 400, roof plate; 500, diaphragm.

DETAILED DESCRIPTION OF THE EMBODIMENTS

The present invention is further illustrated below in combination with the drawings.

Figure 3A:
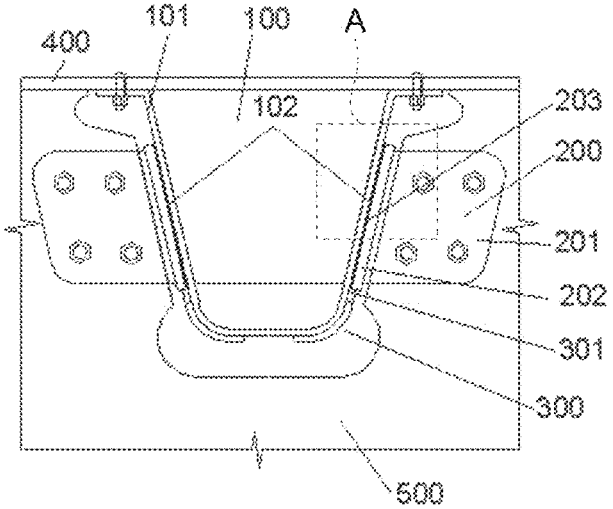
FIG. 3 is a structural diagram of the fatigue damage-avoided orthotropic plate structure.
Figure 3B:
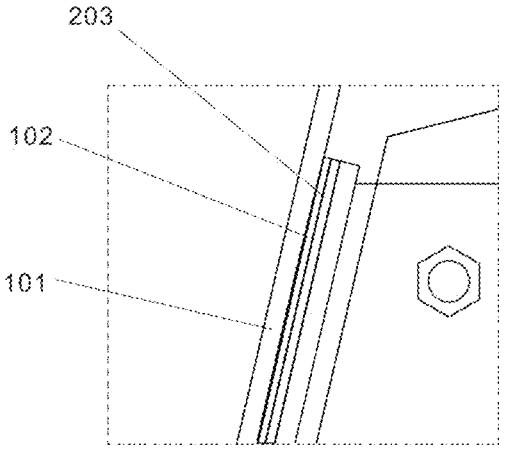

FIG. 3 shows a structural schematic diagram of a replaceable and fatigue-avoided orthotropic plate structure.

The detachable and fatigue-avoided orthotropic plate structure of the present invention includes a plurality of U rib components 100 which are detachably arranged. The U rib component 100 includes the U rib 101, and two sides of the U rib 101 are inclined edges. An upper end of the U rib 101 is fixedly connected to the roof plate 400 in a non-welded manner. Preferably, the U rib 101 and the roof plate 400 are connected by a method including a bolted connection or a riveting connection.

Outer sides of the two sides of the U rib 101 are affixed with the undertaking plate 102, and the undertaking plate 102 is connected to and abuts against the side-inclined limiting component 200. The side-inclined limiting component 200 includes the connecting plate 201 removably installed on the diaphragm 500, the limiting plate 202 vertically arranged on the connecting plate 201, and the friction plate 203 matched with the undertaking plate 102 is installed on the limiting plate 202. The vertical limiting components 300 are symmetrically fixedly arranged on two sides of a bottom of the U rib 101, and an upper end of the vertical limiting component 300 is connected to and abuts against a lower end of the limiting plate 202. The limiting plate 202 is set to support the friction plate 203, thereby enhancing the force bearing capacity of the side-inclined limiting component 200.

Specifically, the thickness of the upper end of the vertical limiting component 300 is greater than the sum of the thicknesses of the undertaking plate 102 and the friction plate 203. When the U rib 101 moves upward, the vertical limiting component 300 is driven to upward squeeze the limiting plate 202, and the upward vertical movement of the U rib 101 is effectively restricted under the action of the limiting plate 202 and the connecting plate 201 fixed on the diaphragm 500.

The distance between upper ends of the limiting plates 202 on two sides is less than the distance between two sides of the upper end of the U rib 101. In this way, the limiting plate 202 can not only bear the transverse deformation force of the U rib 101, but also withstand the longitudinal force caused by the roof plate 400.

Figure 6:
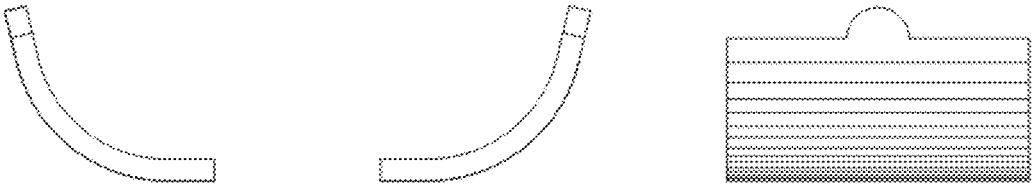
FIG. 6 is a structural schematic diagram of a vertical limiting component in an L shape.

Preferably, the vertical limiting component 300 is arc-shaped, as shown in FIG. 6, and is fitted with bending parts on the two sides of the bottom of the U rib 101. The upper end of the vertical limiting component 300 is provided with the arc-shaped flange 301 which is connected to and abuts against a bottom of the limiting plate 202. The vertical limiting component 300 and the U rib 101 are connected by a method including a bolting connection, a welding connection, a riveting connection and a high-strength adhesive connection, which ensures the consistency of the force bearing on the vertical limiting component 300 and the U rib 101.

Figure 7:
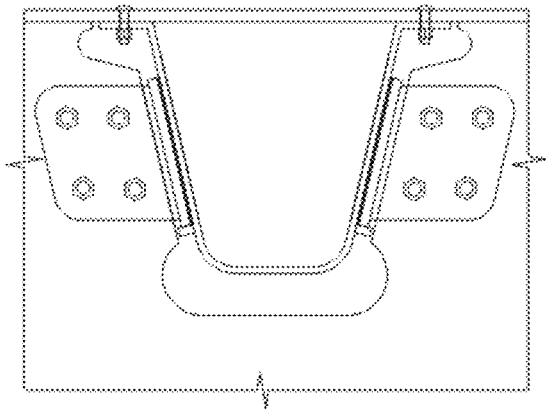
FIG. 7 is a schematic diagram showing an overall structure of a U rib when the vertical limiting component is a limiting bolt.

Optionally, the vertical limiting component 300 is a limiting bolt fixed on the U rib 101, as shown in FIG. 7. The limiting bolt is installed on the bottom of the side of the vertical limiting component 300, and an upper side of the limiting bolt is connected to and abuts against the lower end of the limiting plate 202, which also has the effect of restricting the upward movement of the U rib 101.

Preferably, the upper end of the U rib 101 is provided with an extended flange, and the extended flange and the roof plate 400 are fixedly connected in the non-welded manner, as shown in FIG. 3.

Figure 4:
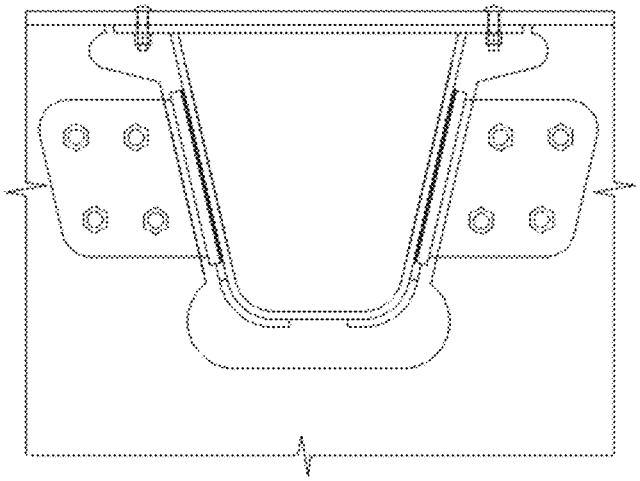
FIG. 4 is a schematic diagram showing an overall structure of a welded U rib with a top cover plate.

Optionally, the upper end of the U rib 101 is provided with a top cover plate fixedly connected to the roof plate 400 by welding, as shown in FIG. 4.

Figure 5:
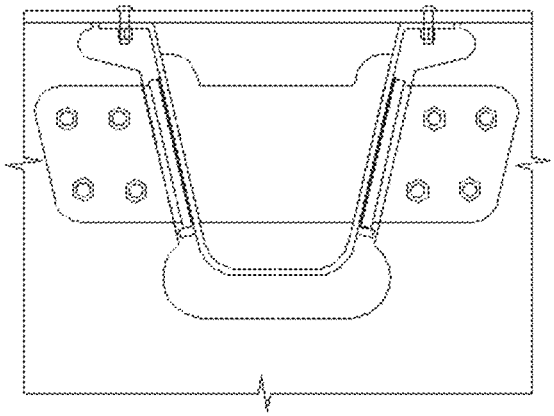
FIG. 5 is a schematic diagram showing an overall structure of a welded U rib with an inner transverse rib.

Optionally, an inner transverse rib plate is arranged at a position on an inner side of the U rib 101 and adjacent to the diaphragm 500, as shown in FIG. 5, so as to increase the structural stiffness of the U rib component 100.

Further, the U rib is a structure modularly prefabricated by the process of rolling, stamping, and cold bending; the side-inclined limiting component 200 and the vertical limiting component 300 are also standardized modular components, which facilitates manufacturing, installation, and replacement.

Preferably, the undertaking plate 102 is a stainless steel plate, and the friction coefficient between the friction plate 203 and the undertaking plate 102 is less than 0.3. The friction plate 203 and the undertaking plate 102 are closely against each other to form a friction pair to restrain the vertical deformation of the U rib 101.

The following is the working principle of the present technical solution:

Through a non-welded connection between the U rib component 100 and the roof plate 400, the vertical downward displacement of the U rib component 100 is limited by the inclined clamping action of the side-inclined limiting component 200, and the vertical upward displacement is limited by both the vertical limiting component 300 and the roof plate 400. Additionally, the transverse displacement is limited by the side-inclined limiting component 200.

Figure 10:
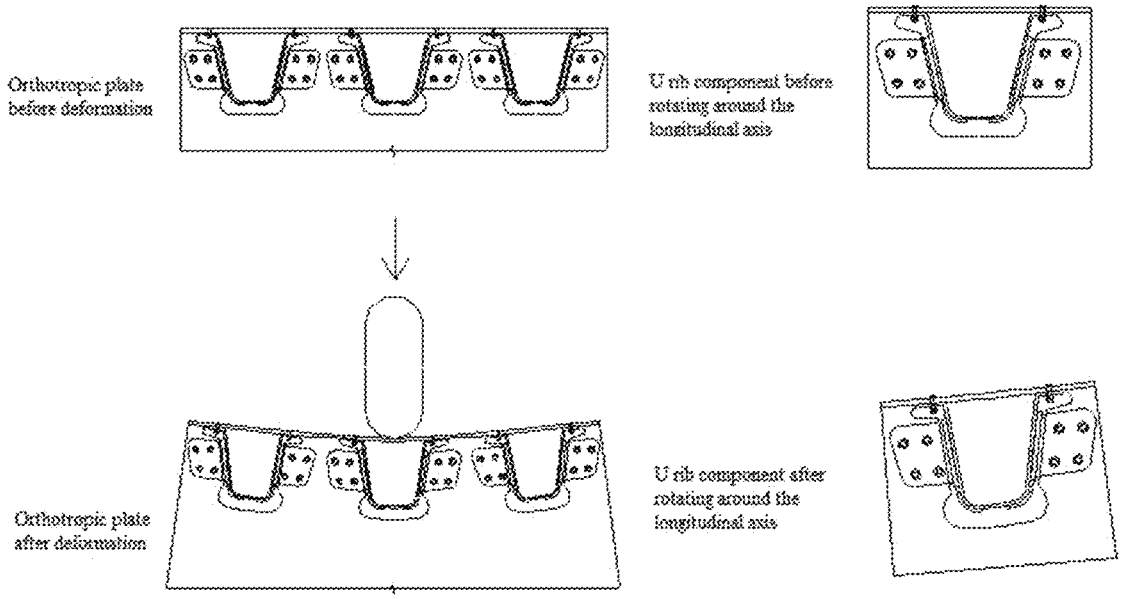
FIG. 10 is a schematic diagram of the lateral deformation of the orthotropic plate structure of the present invention under wheel load.

As shown in FIG. 10, when the U rib component 100 is torsional around the longitudinal axis, the fatigue damage is avoided and will not occur on the U rib 101, the steel roof plate, nor at the weld joint between the U rib 101 and the steel roof plate due to the utilization of the high-strength bolt connection instead of welding between the U rib 101 and the steel roof plate.

Meanwhile, when the U rib 101 is vertically bent around the transverse axis, the fatigue damage of the diaphragm 500 is avoided because a non-welded connection is used between the U rib 101 and the diaphragm 500, the side-inclined limiting component 200 constrains the vertical deformation of the U rib 101 through the friction pair connection, and the U rib 101 can be bent freely around the transverse axis without the out-of-plane bending of the diaphragm 500.

Figure 8:
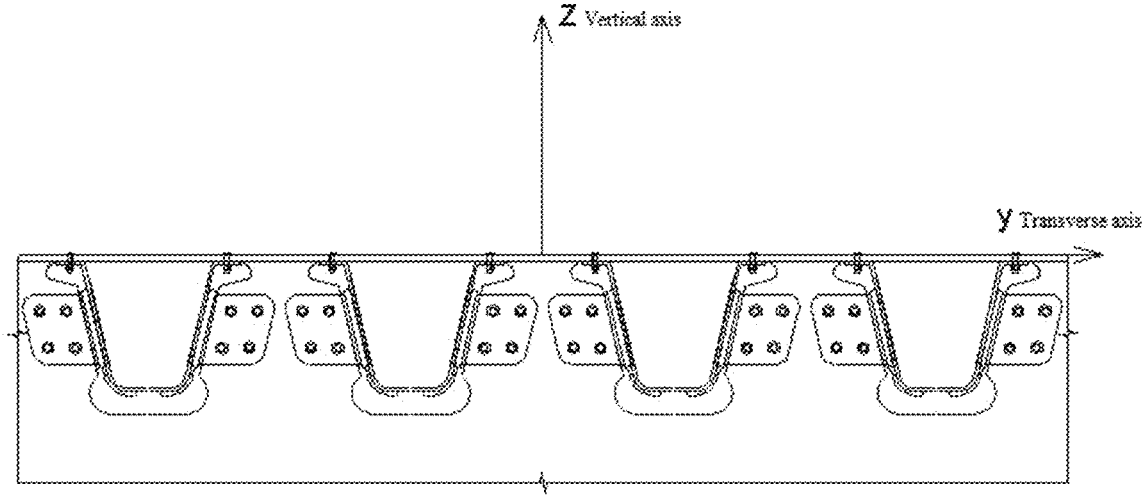
FIG. 8 is an overall side view of an orthotropic plate structure.
Figure 9:
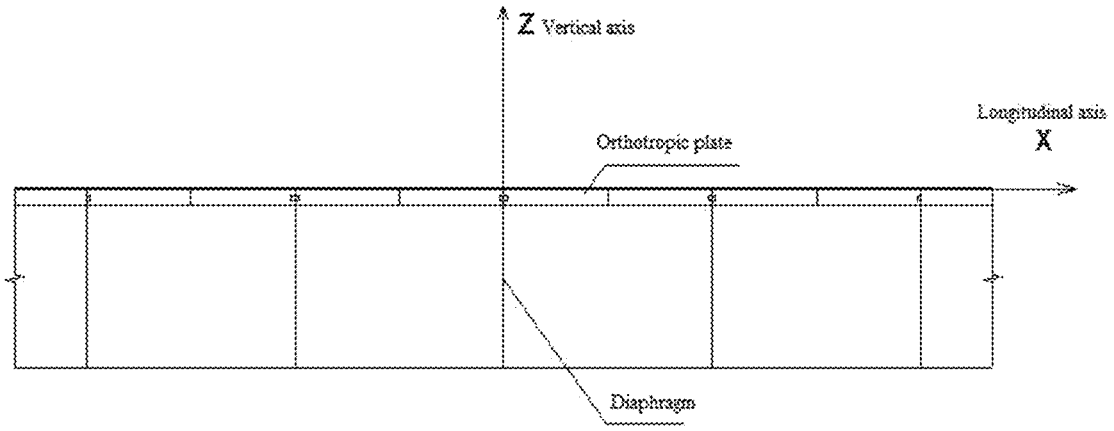
FIG. 9 is an overall top view of the orthotropic plate structure.

Further, as shown in FIGS. 8 and 9, since the U rib component 100 is a modular component and not connected to the diaphragm 500, and the U rib component 100 and the roof plate 400 are connected by the bolted connection or riveting connection, the U rib component 100 and the roof plate 400 are easily disassembled even if the fatigue cracking damage occurs on the U rib component 100 or the connection bolt or rivet, as a result, the modular U rib component 100 can be wholly replaced after the disassembly.

Figure 11:
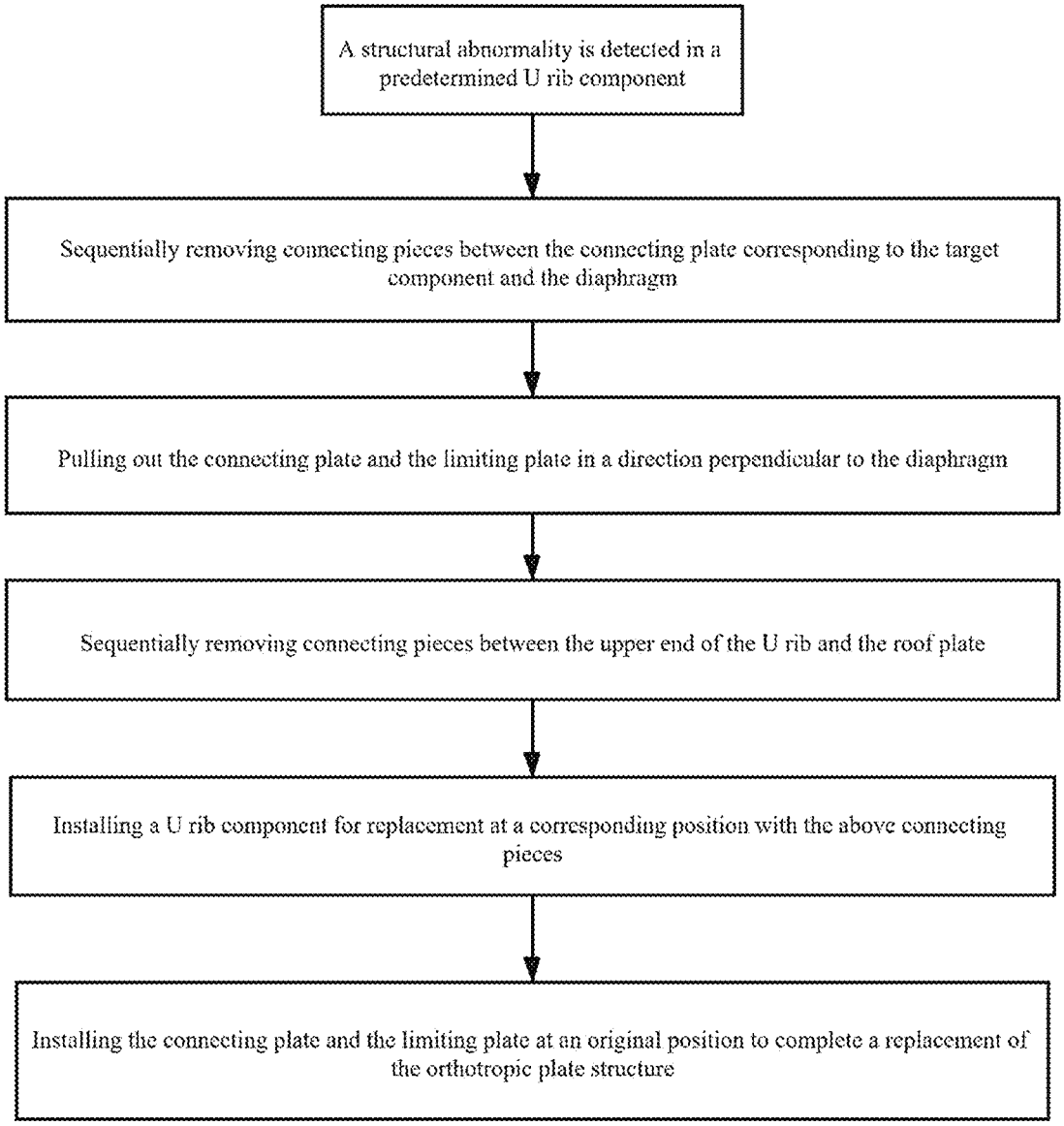
FIG. 11 is a flow chart showing a method for replacing the replaceable and fatigue-avoided orthotropic plate structure.

The present solution also provides a method for replacing the replaceable and fatigue-avoided orthotropic plate structure, as shown in FIG. 11, including the following steps:

S1, when a structural abnormality is detected in the predetermined U rib component 100, connecting pieces between the connecting plate 201 corresponding to the target component and the diaphragm 500 are removed in sequence;

A method for the detection includes a visual inspection, ultrasonic inspection, etc. during conventional periodical inspection.

S2, the connecting plate 201 corresponding to the target component and the limiting plate 202 corresponding to the target component are pulled out in a direction perpendicular to the diaphragm 500, which facilitates the removal of the side-inclined limiting component 200, avoids compressing and affecting the adjacent U rib component 100 and vertical limiting component 300, and simplifies operation simultaneously.

S3, connecting pieces between the upper end of the U rib 101 corresponding to the target component and the roof plate 400 are removed in sequence;

When the connecting pieces are the high-strength bolts, the connecting pieces can be quickly removed with a bolt extractor and collectively placed for recycling.

S4, the U rib component 100 for replacement is installed at a position corresponding to the target component with the connecting pieces obtained in S3;

Further, the U rib 101 for replacement is pre-affixed with the undertaking plate 102. The combined structure of the undertaking plate 102 and the U rib 101 is prefabricated in the factory to facilitate rapid replacement on site.

S5, the connecting plate 201 and the limiting plate 202 obtained in S2 are installed at the original position with the connecting pieces obtained in S1, to complete a replacement of the orthotropic plate structure.

The side-inclined limiting component 200 is reused to save cost and facilitate maintenance operation.

The specific embodiments of the present invention are described above to facilitate the technicians in the art to understand the present invention, but it should be clear that the present invention is not limited to the scope of the specific embodiments. For those of ordinary skill in the art, various changes, as long as within the spirit and scope of the present invention defined and determined by the appended claims, are apparent. All inventions conceived based on the present inventive concept are included in the scope of protection.

What is claimed is:

1. A replaceable and fatigue-resistant orthotropic plate structure, comprising a plurality of U rib components detachably arranged, wherein each of the plurality of U rib components comprises a U rib, and an upper end of the U rib is fixedly connected to a roof plate in a non-welded manner; undertaking plates are attached on outer sides of both sides of the U rib, and each undertaking plate of the undertaking plates abuts against and is connected to a side-inclined limiting component; the side-inclined limiting component comprises a connecting plate detachably installed on a diaphragm, and a limiting plate is arranged vertically on the connecting plate, a friction plate matched with the undertaking plate is installed on the limiting plate, and the friction plate and the undertaking plate are closely against each other to form a friction pair; two sides of a bottom of the U rib are symmetrically fixedly arranged with vertical limiting components, and an upper end of each of the vertical limiting components abuts against and is connected to a lower end of the limiting plate.

2. The replaceable and fatigue-resistant orthotropic plate structure according to claim 1, wherein the vertical limiting components are arc-shaped and fitted with bending parts on the two sides of the bottom of the U rib; the upper end of each of the vertical limiting components is provided with an arc-shaped flange, and the arc-shaped flange abuts against and is connected to a bottom of the limiting plate.

3. The replaceable and fatigue-resistant orthotropic plate structure according to claim 1, wherein the vertical limiting components are limiting bolts fixed on the two sides of the bottom of the U rib, and an upper side of each of the limiting bolts abuts against and is connected to the lower end of the limiting plate.

4. The replaceable and fatigue-resistant orthotropic plate structure according to claim 1, wherein the U rib is a U structure modularly prefabricated by a process of rolling, stamping, and cold bending.

5. The replaceable and fatigue-resistant orthotropic plate structure according to claim 1, wherein the upper end of the U rib is provided with an extended flange, and the extended flange and the roof plate are fixedly connected in the non-welded manner.

6. The replaceable and fatigue-resistant orthotropic plate structure according to claim 1, wherein a thickness of the upper end of each of the vertical limiting components is greater than a sum of thicknesses of the each undertaking plate and the friction plate.

7. The replaceable and fatigue-resistant orthotropic plate structure according to claim 1, wherein an inner transverse rib is arranged at a position on an inner side of the U rib and adjacent to the diaphragm.

8. The replaceable and fatigue-resistant orthotropic plate structure according to claim 1, wherein the each undertaking plate is a stainless steel plate, and a friction coefficient between the friction plate and the each undertaking plate is less than 0.3.

9. A method for replacing the replaceable and fatigue-resistant orthotropic plate structure according to claim 1, comprising the following steps:

S1, when a structural abnormality is detected in a predetermined U rib component, sequentially removing connecting pieces between the connecting plate corresponding to the predetermined U rib component (a target component) and the diaphragm;

S2, pulling out the connecting plate corresponding to the target component and the limiting plate corresponding to the target component in a direction perpendicular to the diaphragm;

S3, sequentially removing connecting pieces between an upper end of a U rib corresponding to the target component and the roof plate;

S4, installing a U rib component for replacement at a position corresponding to the target component with the connecting pieces obtained in S3;

S5, installing the connecting plate obtained in S2 and the limiting plate obtained in S2 at an original position with the connecting pieces obtained in S1, to complete a replacement of the replaceable and fatigue-avoided orthotropic plate structure.

10. The method for replacing the replaceable and fatigue-resistant orthotropic plate structure according to claim 9, wherein the U rib component for replacement is pre-affixed with the undertaking plates.

11. The method for replacing the replaceable and fatigue-resistant orthotropic plate structure according to claim 9, wherein the vertical limiting components are arc-shaped and fitted with bending parts on the two sides of the bottom of the U rib; the upper end of each of the vertical limiting components is provided with an arc-shaped flange, and the arc-shaped flange abuts against and is connected to a bottom of the limiting plate.

12. The method for replacing the replaceable and fatigue-resistant orthotropic plate structure according to claim 9, wherein the vertical limiting components are limiting bolts fixed on the two sides of the bottom of the U rib, and an upper side of each of the limiting bolts abuts against and is connected to the lower end of the limiting plate.

13. The method for replacing the replaceable and fatigue-resistant orthotropic plate structure according to claim 9, wherein the U rib is a U structure modularly prefabricated by a process of rolling, stamping, and cold bending.

14. The method for replacing the replaceable and fatigue-resistant orthotropic plate structure according to claim 9, wherein the upper end of the U rib is provided with an extended flange, and the extended flange and the roof plate are fixedly connected in the non-welded manner.

15. The method for replacing the replaceable and fatigue-resistant orthotropic plate structure according to claim 9, wherein a thickness of the upper end of each of the vertical limiting components is greater than a sum of thicknesses of the each undertaking plate and the friction plate; a distance between an upper end of the limiting plate on a first side of the U rib and an upper end of the limiting plate on a second side of the U rib is less than a distance between two sides of the upper end of the U rib.

16. The method for replacing the replaceable and fatigue-resistant orthotropic plate structure according to claim 9, wherein an inner transverse rib is arranged at a position on an inner side of the U rib and adjacent to the diaphragm.

17. The method for replacing the replaceable and fatigue-resistant orthotropic plate structure according to claim 9, wherein the each undertaking plate is a stainless steel plate, and a friction coefficient between the friction plate and the each undertaking plate is less than 0.3.

* * * * *